US005813264A

United States Patent [19]

Steingroever

[11] Patent Number: 5,813,264

[45] Date of Patent: Sep. 29, 1998

[54] METHOD FOR FORMING A WORKPIECE BY A MAGNETIC FIELD GENERATED BY A CURRENT IMPULSE

[75] Inventor: Erich Steingroever, Bonn, Germany

[73] Assignee: Magnet-Physik Dr. Steingroever GmbH, Germany

[21] Appl. No.: 746,875

[22] Filed: Nov. 15, 1996

[30] Foreign Application Priority Data

Jan. 27, 1996 [DE] Germany ..... 196 02 951.1

[51] Int. Cl.[6] ..... B21D 26/14

[52] U.S. Cl. ..... 72/56; 72/62

[58] Field of Search ..... 72/56, 60, 54, 72/61, 62

[56] References Cited

U.S. PATENT DOCUMENTS

| | | | |
|---|---|---|---|
| 3,321,946 | 5/1967 | Ferguson | 72/56 |
| 3,345,732 | 10/1967 | Brower | 72/56 |
| 4,063,208 | 12/1977 | Bernett | 72/56 |
| 4,135,379 | 1/1979 | Hansen et al. | 72/56 |
| 4,285,224 | 8/1981 | Shkatov | 72/56 |
| 4,619,127 | 10/1986 | Sano et al. | 72/56 |
| 5,442,846 | 8/1995 | Snaper | 72/56 |
| 5,457,977 | 10/1995 | Wilson | 72/56 |

FOREIGN PATENT DOCUMENTS 4423992 9/1995 Germany .

*Primary Examiner*—David Jones
*Attorney, Agent, or Firm*—Harold Gell

[57] ABSTRACT

A method for forming and joining workpieces by a magnetic field produced by a current impulse applied through a high current loop, whereby the magnetic field exerts a force from outside on an electrically conducting workpiece or on electrically conducting compression rings encircling the workpiece, wherein the current impulse begins in the form of a half sine wave defined by the equation ($\omega t=0 \ldots \pi$); and then fades away as defined by the equation ($\omega t>\pi \ldots \infty$).

20 Claims, 2 Drawing Sheets

FIG.3
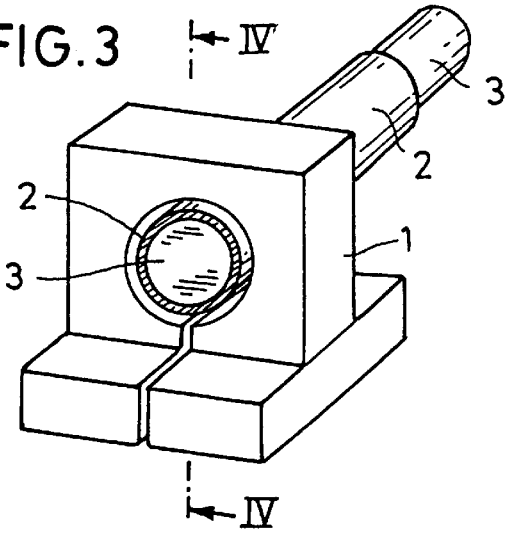
FIG.4
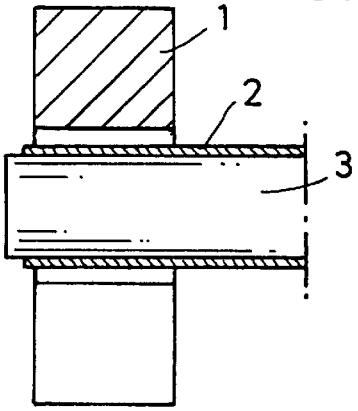
FIG.5
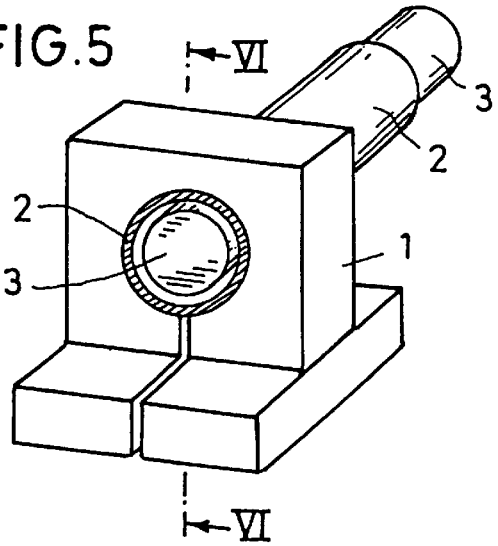
FIG.6
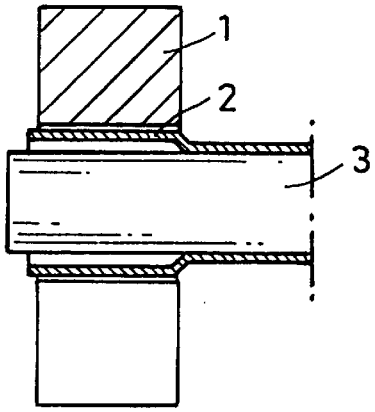
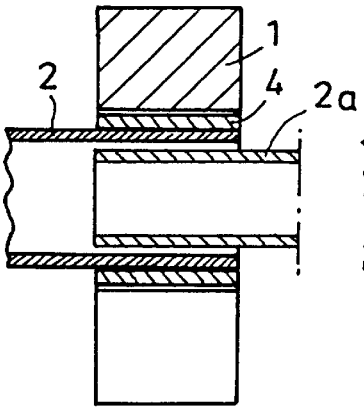
FIG.7
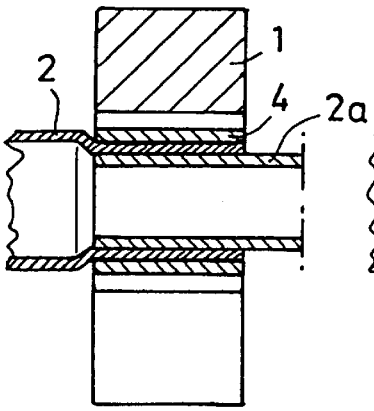
FIG.8
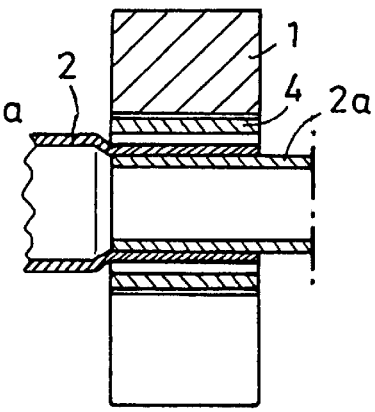
FIG.9

METHOD FOR FORMING A WORKPIECE BY A MAGNETIC FIELD GENERATED BY A CURRENT IMPULSE

FIELD OF THE INVENTION

The invention applies to a process for the form changing of a workpiece by a magnet field produced in a high current loop by a current impulse, whereby the magnet field affects electrically conducting raw material from outside via a ring or a tube form.

BACKGROUND OF THE INVENTION

Processes are known using magnetic forming machines for a multitude of operations, like compression and expansion of tubular parts, forming, stamping, uniting, joining and enveloping by loose parts, pressing, cutting, shearing and similar processing processes accomplished with simple tools.

One type of magnetic forming machine discharges condensers through a high current loop to produce magnetic fields having field intensities of up to 30,000 gauss for periods up to 20 microseconds. A period of some seconds is necessary for charging the condenser, so the entire processing cycle takes about 6 seconds.

Three basic types of high current loops or high current coils are incorporated in such machines, covering most applications of magnetic forming. The first type of high current loop or coil surrounds the workpiece and serves to press together tubular parts, i.e. press-forms parts together as required for plugs, fittings, electrical terminals and connecting sleeves. The shaping of the tubular part by the magnetic power in this type is so strong that the metal penetrates in a number of bands around the tubular parts and creates thereby a high strength, solid bond.

The coil of the second type is placed in the bore of a tube from which a part is formed by expansion, whereby a flange, or for instance, circular ridges are produced through application of magnet power. Thereby high current loops or coils can be inserted to form different profiles or with the help of a die, spines or tube threads.

A third type of high current loop or coil serve for profiling flat workpieces and also for stamping, cutting and punching operations.

Another application of the magnetic forming process is the shaping of an aluminum ring to hold together the stator and the rotor of electric motors. The different loose parts are placed in order within the ring and the assembly is inserted into the high current loop. If the high current loop or coil former is excited, the metal ring will be shaped through the effect of the magnetic power to such an extent that it will be forced into all recesses in the stator end and also formed around the end. In this way bolts and the failure thereof will be avoided as well as soldering, brazing and other assembly processes.

The magnetic forming process can be used for broad applications for the shaping light and mid-weight metals having good electric conductivity such as brass, coppers, aluminum and molybdenum. Stainless steel having a slight electrical conductivity can be shaped with the help of an aluminum sheath or layer, or after copper or other good electrically conductive materials have been applied to the surface by galvanizing.

The underlying purpose of the invention is to improve the process of magneforming so that ring and tubular shaped parts may be manufactured with superior consistency and precision by a simple, fast and low-priced technique which may also be used for securely joining interfitting parts, particularly if the meshing parts have a close fit.

This task is solved by a process according to the invention whereby a current impulse in the area of ($\omega t=0 \ldots \pi$) has the form of a half sine wave and then ($\omega t>\pi \ldots \infty$) as the cycle is reduced or fades away or becomes a nonentity.

According to the invention, the processes have the advantage in that tubes and tubular workpiece shapes may be created simply and with high precision and consistency of form without recourse to mechanical tools and will be firmly interconnected.

An example of the application of the invention is a procedure for the manufacture of rotors with permanent magnets and metal casings which produces an especially firm seat of the metal casing on the permanent magnet and which provides very fast processing and permits simplified automatic handling.

Prior to the present invention, such a process for manufacturing rotors with permanent magnets and metal sheaths or casings by magnetic forming was not known. It is generally believed that the permanent magnets of such rotors produced through the use of a high current loop or a magnetic field concentrator producing a strong magnet field in the wrong direction, namely axial, cause the prior permanent magnetism of the rotor magnets to become weak. However, the inventor has ascertained with great surprise, that that is not so. The previously described prior art magnetic forming processes have been known for decades, but they have caused a prejudice against the application of the process in accordance to the present invention, thus it was never placed in consideration. Through the unexpected method of the existing invention, the existing disbelief will be overcome.

A according to the invention it is possible to accomplish magnetic shaping of iron or steel casings as well as casings of an electrically nonconductive material with a shell of an electrically conductive raw material, such as an aluminum sheath, surrounding the casing to allow the current passage necessary for magnetic shaping. This sheath can be removed after the shaping of the iron or steel case by turning it off on a lathe or if it has a conical form, the sheath may be pressed off.

In a similar manner, poor conducting steel tubes may be shrunk with a pressure ring of an electrically conductive material, such as copper, aluminum or similar material. The magnetic shaping process pushes the metal of the pressure ring which pushes steel tube before it. The ring can remain either on the steel tube or may be widened according to the invention through the impulse of the second quarter wave the half sine wave, so that the steel tube can be easily extracted. The expansion process can be used alone, without an additional pressure ring, for tubes fabricated from electric good conducting raw materials.

BRIEF DESCRIPTION OF THE DRAWINGS

The following impulse-diagrams and schematic drawings depict the invention, wherein;

FIG. 3 is a prospective view of a field concentrator illustrating a tube to be expanded which is fabricated from an electrically conductive raw material FIG. 4 is a vertical sectional view through the field concentrator and tube to be expanded taken along the line IV—IV of FIG. 3, FIG. 5 is a prospective view of a field concentrator with the tube expanded, FIG. 6 is a sectional view taken along the line VI—VI of FIG. 5, FIG. 7 a schematic sectional view through a field concentrator arranged in a first work step to shrink a steel tube onto a tube by means of a pressure ring fabricated from an electrically conductive raw material, FIG. 8 is the second work step in the shrink-process and FIG. 9 illustrates the expansion and removing of the pressure ring in a third work step.

DETAILED DESCRIPTION OF PREFERRED EMBODIMENTS

The following is a more precise explanation of the invention.

Figure 1:
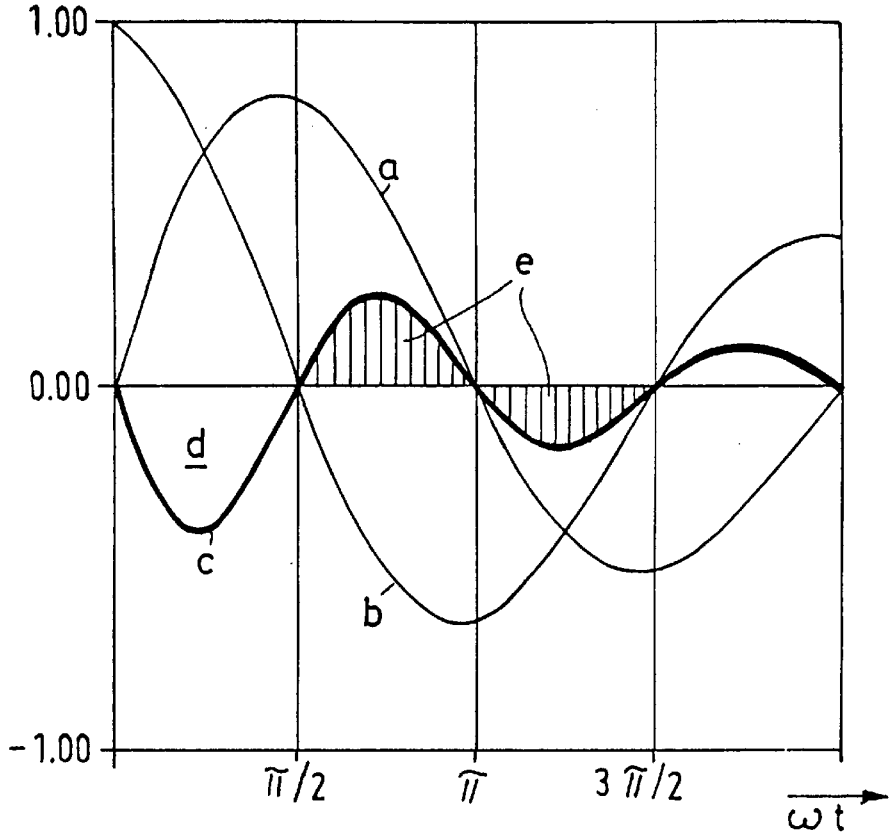
FIG. 1 is a first impulse-diagram depicting the current impulse in the area of ($\omega t=0 \ldots \pi$) having the form of a half sine wave and then ($\omega t>\pi \ldots \infty$) as the sine wave is damped or fades away.
Figure 2:
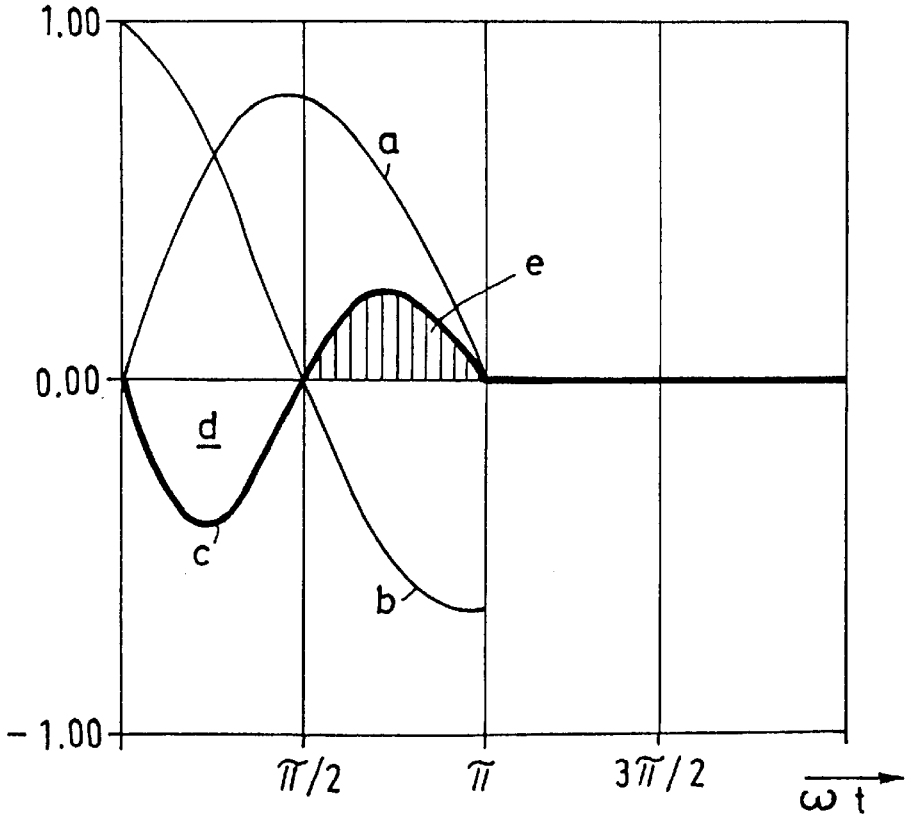
FIG. 2 is a second impulse-diagram depicting the current impulse in the area of ($\omega t=0 \ldots \pi$) having the form of a half sine wave and then ($\omega t>\pi$) when the current is 0 and the sine wave a nonentity.

The impulse diagrams of FIG. 1 and FIG. 2 show both curves of the current impulses produced in a field concentrator 1; the curve in the form of a half sine wave followed by the damped wave as the cycle fades away, and followed by zero when the sine wave becomes a nonentity. Zero and the current curves represent the electromagnetic force produced by the field concentrator in FIG. 3 through FIG. 9.

In FIG. 1 and FIG. 2, the curves a and b for the current development result in curve c and the electromagnetic power developed in the field concentrator, the areas marked d and e are defined as follows:

a: $I\ \Delta\ \sin \omega t \cdot e^{-\omega t/\omega\tau}$ with $\omega\tau=7$ b: $dI/dt\ \Delta\ \cos \omega t \cdot e^{-\omega t/\omega\tau}$ c: $P\ \Delta\ -I \cdot dI/dt$=pressure d: Compression ($\omega t=0 \ldots \pi/2$)

e: Depression=expansion ($\omega t=\pi/2 \ldots 3\pi/2$)

After the current impulse illustrated in FIG. 1 is in the area of ($\omega t=0 \ldots \pi$), the half sine wave becomes slightly damped ($\omega t=7$) and then it is reduced further ($\omega t>\pi \ldots \infty$).

This current flow results in the process illustrated in FIG. 3 through FIG. 6 which is the process of the expansion of pipes or tubular workpieces 2 fabricated from electrically conductive, ductile, raw material such as Cu, Al or similar alloys, the end of which is inserted into a limiting guide, and for the process illustrated in FIGS. 7 through 9 which use the expansion of a pressure ring 4.

FIGS. 3 and 4 illustrate the shaping, by expansion, of tube 2 with a support core 3 in place to prevent shrinkage during the first quarter wave of the current impulse ($\omega t=0 \ldots \pi/2$).

In FIGS. 5 and 6 the expanded tube 2 is shown with the support core 3 continued in place during the second quarter wave ($\omega t=\pi/2 \ldots \pi$). Also during the third quarter wave step an expansion force still appears; but it is slighter than that occurring during the second quarter wave.

The support core 3 is constructed either from a raw material with slight electric conductivity or from a nonconductive material such as Z, B, brass, plastic, ceramics or such.

The execution of a second forming method is demonstrated in sequential work steps by FIGS. 7 through 9. This process is for form changing workpieces and for joining tubes 2, 2*a* fabricated from electrically nonconductive raw materials, such as steel and similar alloys. In this method, during the first quarter wave of the current ($\omega t=0 \ldots \pi/2$), the magnetic field of the current impulse compresses a pressure ring 4 fabricated from an electrically conductive raw material, such as copper, on the tube or tubular workpiece 2 to be shaped (FIG. 8). This shrinks the tube 2 to firmly join it with the inserted second tube 2*a*. During the second and third quarter wave ($\omega t=\pi/2 \ldots 3\pi/2$) the current impulse (FIG. 9) created magnetic field works the pressure ring 4 in the reverse direction and widens it so that the shaped tube or workpiece 2 can be easily removed.

These three successive work step are illustrated in FIGS. 7 through 9 using a combination of two tubes 2, 2*a* pushed into each other. They are fabricated from electrically nonconductive raw materials, like steel or similar alloys. As shown, they are closely fit and both are positioned in pressure ring 4 which is fabricated from an electric good conducting raw material, like particularly copper. Tubes 2, 2*a* compressed and will in this way be firm interrelated.

The shaping magnetic field produced for all embodiments of the invention is created by a field concentrator 1 (field shaper) connected at the secondary of an impulse transformer as described in German Patent D 44 23 992 C2.

To cause the expansion of tubes or a pressure ring 4, the impulse must be strong but is chosen so that the tube 2 in FIG. 6 or the pressure ring 4 in FIG. 9 will fit with play in the opening of the field concentrator 1 so they can be pulled out from the opening.

Alternatively, a field concentrator can be effected directly as a high strength field coil without being part of an impulse transformer.

The invention processes can also be used for shaping small diameter tubes, particularly those fabricated from steel, steel alloys, light metal alloys and such, having an unround profile (for example hexagonal), a thread or winding profile, configured as a fitting, and on other smaller tubes or such, whereby a formed and measured support core is inserted in the tube or tubular workpiece to be shaped.

What is claimed:

1. A method for forming a workpiece by a magnetic field including the steps of:

producing a high current impulse;

producing said magnetic field by applying said high current impulse through a high current loop circuit located in its entirety outside said workpiece, whereby said magnetic field exerts a force on an electrically conducting object selected from the group comprised of workpiece compression rings and workpieces;

beginning said high current impulse in the form of a half sine wave defined by the equation ($\omega t=0 \ldots \pi$); and reducing the cycle of said high current impulse to cause it to fade away as defined by the equation ($\omega t>\pi \ldots \infty$).

2. A method according to claim 1, characterized in that said electrically conductive objects are ductile and selected from the class of raw materials including Cu, AL and corresponding alloys.

3. A method according to claim 2, wherein said workpiece is a tubular workpiece furnished with a support core to prevent shrinking during the first quarter wave of said current impulse defined by the equation ($\omega t=0 \ldots \pi/2$), and allow said tubular workpiece to expand during the second quarter wave defined by the equation ($\omega t=\pi/2 \ldots \pi$).

4. A method according to claim 3, wherein said support core is fabricated from a raw material selected from the class of materials comprised of material with slight electrical conductivity and nonconducting materials including brass, plastic and ceramic.

5. A method according to claim 2, wherein said electrically conducting object is a workpiece compression ring and said workpiece is tubular and fabricated from electrically nonconductive raw materials, such as steel and like alloys and wherein said magnetic field created by said current impulse during the first quarter wave of the current as defined by the equation ($\omega t=0 \ldots \pi/2$) compresses said compression ring onto said workpiece so that it shrinks; and during the second quarter wave of said current impulse as defined by the equation ($\omega t=\pi/2 \ldots \pi$), said compression ring is expanded so said workpiece can be easily removed.

6. A method according to claim 5, wherein said magnetic field is produced through a field concentrator comprised of said high current loop.

7. A method according to claim 1, wherein said magnetic field is produced through a field concentrator comprised of said high current loop.

8. A method according to claim 7, wherein said field concentrator is the secondary of an impulse transformer.

9. A method according to claim 7, wherein said field concentrator is a high strength field coil.

10. A method according to claim 5 for shaping small diameter tubes fabricated from steel, steel alloys, light metal-alloys and such, wherein the shape produced by said shaping is selected from the class of shapes including unround profiles, hexagons, threads, winding profiles, fitting, and other smaller tubes.

11. A method for forming a workpiece by a magnetic field including the steps of:

producing a high current impulse;

producing said magnetic field by applying said high current impulse through a high current loop circuit located in its entirety outside said workpiece, whereby said magnetic field exerts a force on an electrically conducting object selected from the group comprised of workpiece compression rings and workpieces;

beginning said high current impulse in the form of a half sine wave defined by the equation ($\omega t=0 \ldots \pi$); and reducing said high current impulse to a nonentity.

12. A method according to claim 11, characterized in that said electrically conductive objects are ductile and selected from the class of raw materials including Cu, AL and corresponding alloys.

13. A method according to claim 12, wherein said workpiece is a tubular workpiece furnished with a support core to prevent shrinking during the first quarter wave of said current impulse defined by the equation ($\omega t=0 \ldots \pi/2$), and allow said tubular workpiece to expand during the second quarter wave defined by the equation ($\omega t=\pi/2 \ldots \pi$).

14. A method according to claim 13, wherein said support core is fabricated from a raw material selected from the class of materials comprised of material with slight electrical conductivity and nonconducting materials including brass, plastic and ceramic.

15. A method according to claim 12, wherein said electrically conducting object is a workpiece compression ring and said workpiece is tubular and fabricated from electrically nonconductive raw materials and wherein said magnetic field created by said current impulse during the first quarter wave of the current as defined by the equation ($\omega t=0 \ldots \pi/2$) compresses said compression ring onto said workpiece so that it shrinks; and during the second quarter wave of said current impulse as defined by the equation ($\omega t=\pi/2 \ldots \pi$), said compression ring is expanded so said workpiece can be easily removed.

16. A method according to claim 15, wherein said magnetic field is produced through a field concentrator comprised of said high current loop.

17. A method according to claim 11, wherein said magnetic field is produced through a field concentrator comprised of said high current loop.

18. A method according to claim 17, wherein said field concentrator is the secondary of an impulse transformer.

19. A method according to claim 17, wherein said field concentrator is a high strength field coil.

20. A method according to claim 15 for shaping small diameter tubes fabricated from steel, steel alloys, light metal-alloys and such, wherein the shape produced by said shaping is selected from the class of shapes including unround profiles, hexagons, threads, winding profiles, fitting, and other smaller tubes.

* * * * *